US008480769B2

(12) United States Patent
D'Agostini

(10) Patent No.: US 8,480,769 B2
(45) Date of Patent: Jul. 9, 2013

(54) METHOD FOR GASIFICATION AND A GASIFIER

(75) Inventor: Mark Daniel D'Agostini, Ebensburg, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 12/845,826

(22) Filed: Jul. 29, 2010

(65) Prior Publication Data

US 2012/0023823 A1 Feb. 2, 2012

(51) Int. Cl.
*C10J 1/207* (2012.01)
*B01J 7/00* (2006.01)

(52) U.S. Cl.
USPC ..... 48/76; 48/61; 48/127.9; 48/77; 48/117; 48/63; 48/105; 48/107; 431/79; 431/75; 431/11; 431/12; 110/263; 110/264; 110/265; 110/266

(58) Field of Classification Search
USPC ..... 48/61, 127.9
See application file for complete search history.

(56) References Cited

U.S. PATENT DOCUMENTS

| | | | | |
|---|---|---|---|---|
| 3,566,809 | A * | 3/1971 | Carry et al. | 110/187 |
| 4,378,974 | A * | 4/1983 | Petit et al. | 48/197 R |
| 4,489,562 | A | 12/1984 | Snyder et al. | |
| 4,565,137 | A * | 1/1986 | Wright | 110/264 |
| 5,554,202 | A | 9/1996 | Brooker et al. | |
| 5,878,700 | A | 3/1999 | Farzan et al. | |
| 6,074,623 | A * | 6/2000 | Vick et al. | 423/418.2 |
| 6,093,372 | A | 7/2000 | Wallace et al. | |
| 6,254,851 | B1 | 7/2001 | Kohno et al. | |
| 6,269,286 | B1 | 7/2001 | Tse et al. | |
| 6,905,668 | B1 | 6/2005 | Kohno et al. | |
| 6,910,432 | B2 | 6/2005 | D'Agostini et al. | |
| 6,968,791 | B2 | 11/2005 | D'Agostini et al. | |
| 7,569,208 | B2 | 8/2009 | Kohno et al. | |
| 2005/0019252 | A1 | 1/2005 | Kohno et al. | |
| 2005/0019253 | A1 | 1/2005 | Kohno et al. | |
| 2005/0032148 | A1 | 2/2005 | Kohno et al. | |
| 2007/0137537 | A1 | 6/2007 | Drisdelle et al. | |
| 2008/0280237 | A1 * | 11/2008 | Just et al. | 431/4 |
| 2009/0308334 | A1 | 12/2009 | Geest et al. | |

FOREIGN PATENT DOCUMENTS

| | | | |
|---|---|---|---|
| CN | 101684939 | A | 3/2010 |
| EP | 0 047 349 | B1 | 10/1983 |
| EP | 1 115 813 | B1 | 4/2005 |
| EP | 0 986 623 | B1 | 8/2005 |

(Continued)

OTHER PUBLICATIONS

Phan, P., et al; "Analysis of Material Loss from Brittle Erosion"; Journal of Enigneering Technology and Education; vol. 5, No. 2; Jun. 2008; pp. 141-155.

(Continued)

*Primary Examiner* — Kaity V. Handal
(74) *Attorney, Agent, or Firm* — Michael K. Boyer; Larry S. Zelson

(57) ABSTRACT

Disclosed is a cyclonic gasifier and cyclonic gasification method. The cyclonic gasifier and cyclonic gasification method involve a chamber having a first portion proximal to a first end and a second portion proximal to a second end, introducing a first fuel to the first portion of the chamber, introducing a second fuel to the chamber; and introducing a first oxidant to accelerate the velocity of the first fuel and swirl the first fuel from the first portion toward the second portion.

13 Claims, 13 Drawing Sheets

FOREIGN PATENT DOCUMENTS

| | | | |
|---|---|---|---|
| GB | 2138841 | | 10/1984 |
| JP | 63264696 | A | 11/1988 |
| WO | 2005/106327 | A1 | 11/2005 |
| WO | 2006/128286 | A1 | 12/2006 |
| WO | 2007131235 | A2 | 11/2007 |
| WO | 2007131239 | A2 | 11/2007 |

OTHER PUBLICATIONS

American Coal Ash Association; Resource Bulletin; RB-23; Aug. 2004.

D'Agostini; "Method and System for Controlled Gasification", U.S. Appl. No. 12/845,879, filed Jul. 29, 2010.

* cited by examiner 309
302
306
400
402
406
300

302
702
D
X
306
400
402
406
418
300

Figure. 1 Erosion response on brittle and ductile materials [3]

METHOD FOR GASIFICATION AND A GASIFIER

BACKGROUND OF THE INVENTION

The present invention is directed to a method of gasification and a gasifier. More specifically, the present invention relates to a method of gasification and a gasifier involving cyclonic gasification.

Generally, operation of known cyclonic reactors can present drawbacks. Due to temperature gradients within a cyclonic reactor, there is a tendency for slag to solidify within the reactor, most particularly in the region near where the slag exits the reactor. For example, in known cyclonic reactors, the slag travels through the slag tap and the slag transfers heat by radiation to a cooler environment such as a quench tank. Heat loss from the slag near the slag tap may be relatively high due to the large thermal gradient between the reactor and the quench tank. High heat loss sharply increases the viscosity of the slag, thereby decreasing the flow rate of the slag and often leads to solidification of the slag. This process of slag cooling, viscosity increase, and solidification can lead to a decrease in thermal efficiency for the reactor, an increase in particulate emissions, and/or operational shutdown.

Known cyclonic reactors may erode walls of the reactor by particle-laden flows having high velocity (for example, velocity in excess of about 200 ft/s). In general, when reactor walls include refractory material as a wall insulating material, eroded portions of the refractory material must be replaced regularly to avoid vessel damage or destruction. The replacement of the portions of the refractor wall results in material costs for the replacement material, operational costs for handling the replacement of the refractory material, and an inability to use the reactor during the replacement of the refractory material.

The effectiveness of certain processes and the range of chemical interaction capable is limited by the volume of the reactor. In general, cyclonic reactors involve high velocity injection and also employ relatively high ratios of heat release per unit of volume (for example, in excess of about 10 MW thermal/m3). In order for solid fuels to burn, the solid fuels must first undergo heating, followed by volatilization, then oxidation. Each process is time-dependent and the volume of the reactor affects the duration of time for the process (i.e., for a given heat release, a larger volume permits a longer duration for the process). The known reactors are constrained by the relatively short gas residence time (for example, about one second) available in the cyclonic reactor. Thus, slow burning fuel feedstocks, such as those with high moisture level (for example, exceeding about 15% by weight) or large particle size (for example, having a dimension of about ¼ inch), may not be oxidized to a desirable degree, resulting in reduced fuel utilization and/or reduced efficiency for combustion and/or gasification.

WO 2005/106327, which is hereby incorporated by reference in its entirety, discloses a cyclonic plasma pyrolysis/vitrification system pyrolyzing and vitrifying waste materials into exhaust gas and slag using a plasma torch. This system reduces toxic materials such as heavy metals. This system melts fly ash after being absorbed at the inner walls of a reactor under the centrifugal force formed by the plasma torch. In this system, the plasma torch is inclined at a predetermined angle with respect to an internal bottom surface of the reactor. This system includes an auxiliary reactor for receiving exhaust gas from the main reactor. This auxiliary reactor is positioned on a side of the main reactor. This system requires an afterburner to increase the temperature of exhaust gases. In addition, this system requires a separator wall exposed to relatively high temperatures on both sides (for example, above about 1400° C.) without a heat sink, thereby risking high temperature failure of this element. This system can also result in erosion of the reactor wall caused by a high power/velocity plasma jet directed between about 20 and 40 degrees above the plane of the surface of impingement.

U.S. Pat. No. 6,910,432, which is hereby incorporated by reference in its entirety, discloses a method for combusting a solid fuel in a slagging cyclone reactor having a burner and a barrel. The method involves injection of two oxidant streams, a first oxidant stream having an oxygen concentration of about 21% by volume and a second oxidant stream having an oxygen concentration greater than the oxygen concentration of the first stream. The two streams are selectively injected into a cyclone combustor whereby mixing of the two oxidant streams is such that a part of the first oxidant stream remains unchanged from its original concentration in the barrel of the combustor. This method does not include a secondary fuel within the cyclonic reactor and can result in erosion of the reactor wall due to high velocity injection.

U.S. Pat. No. 6,968,791, which is hereby incorporated by reference in its entirety, discloses a method for operating a cyclone reactor. The cyclone reactor includes a barrel having a burner end (the front or inlet end) and a throat (the rear or the exhaust end), two burners in communication with the barrel, a stream of primary fuel and primary oxidant, and a stream of secondary fuel and a secondary oxidant, wherein the oxygen concentration of the first oxidant is about 21% by volume and the oxygen of the second concentration is greater than about 21% by volume. The secondary fuel and oxidant are introduced at the burner end. The products of secondary fuel and oxidant combustion exit at the throat end, and the secondary flame generated by the secondary fuel and the oxidant generates a supplemental radiant heat within the cyclone. Additionally, this method can also be prone to refractory erosion.

U.S. Pat. No. 7,621,154, which is hereby incorporated by reference in its entirety, discloses a method for supplying heat to a melting furnace for forming a molten product. A first fuel having an ash component and a first oxidant is introduced into a slagging chamber along with a second fuel and a second oxidant, the second oxidant having an oxygen concentration between about 22% by volume and 100% by volume. At least a portion of the first fuel and a second fuel is combusted within the slagging chamber, while the ash component is collected as a layer of molten slag and is withdrawn from the slagging chamber. Slagging combustor gas effluent is passed from the slagging chamber into a combustion space of the melting furnace at a temperature between about 1000° C. and about 2500° C. to supply heat to form the molten slag.

What is needed is a gasification method and a cyclonic gasifier wherein the temperature and viscosity of slag within the gasifier are maintained, the gasifier is substantially protected from erosion, oxidant(s) use little or no inert gas, gas momentum for gasification is maintained, a compact arrangement provides a high heat release to volume ratio, solid fuel particles can be rapidly heated and/or ignited, and/or residence time and uniformity of temperature distribution can be extended.

BRIEF SUMMARY OF THE INVENTION

One aspect of the present disclosure includes a cyclone gasifier. The cyclone gasifier includes a chamber, a first fuel injector, a burner, and an oxidant injector. The chamber has a first portion proximal to a first end and a second portion proximal to a second end. The first fuel injector is positioned for introducing a first fuel to the first portion of the chamber. The burner includes a second fuel injector positioned for introducing a second fuel to the second portion of the chamber and is configured to direct a flame toward the first portion from the second portion. The first oxidant injector is configured to accelerate the velocity of the first fuel and swirl the first fuel from the first portion toward the second portion. The second portion includes a flow path for a product gas formed by gasification of the first fuel, the second fuel, or a combination thereof. The first fuel includes a solid fuel.

Another aspect of the present disclosure includes a cyclone gasifier. The cyclone gasifier includes a chamber having a first portion proximal to a first end and a second portion proximal to a second end, a first fuel injector positioned for introducing a first fuel to the first portion of the chamber, a burner including a second fuel injector positioned for introducing a second fuel to the chamber, an accelerating oxidant injector configured to accelerate the velocity of the first fuel and swirl the first fuel from the first portion toward the second portion, and an annular oxidant injector. The second portion includes a flow path for a product gas formed by gasification of the first fuel, the second fuel, or a combination thereof. The annular oxidant injector is arranged around the first fuel injector to promote the gasification of at least the first fuel. The first fuel includes a solid fuel.

Another aspect of the present disclosure includes a cyclone gasification method. The method includes providing a chamber having a first portion proximal to a first end and a second portion proximal to a second end, introducing a first fuel to the first portion of the chamber, introducing a second fuel to the chamber and oxidizing the second fuel with oxygen, introducing an accelerating oxidant to accelerate the velocity of the first fuel and swirl the first fuel from the first portion toward the second portion, and one or more of directing a flame toward the first portion from the second portion, the flame being formed by the oxidizing of the second fuel, and promoting gasification of at least the first fuel by introducing an annular oxidant around the first fuel with an annular oxidant injector. The second fuel differs from the first fuel in composition. The first fuel includes a solid fuel.

An advantage of the present disclosure includes control of slag temperature and viscosity, which can reduce or eliminate operational shutdowns due to slag cooling and thickening.

Another advantage of the present disclosure includes introducing solid fuel with a low angle of attack relative to the reactor wall, thereby reducing wall refractory erosion and extending the life of refractory material.

Another advantage of the present disclosure includes maintaining cyclonic action while using an oxidizer with a low concentration of inert gas, thereby reducing the adverse effects of inert gas on gasification processes.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Provided is a method of gasification and a gasifier involving cyclonic gasification. Embodiments maintain the temperature and viscosity of slag within the gasifier, substantially protect the gasifier from erosion, utilize oxidant(s) having little or no inert gas, retain gas momentum for gasification, include compact arrangement with a high heat release to volume ratio, rapidly heat and ignite solid fuel particles, and/or extend residence time and uniformity of temperature distribution.

Figure 1:
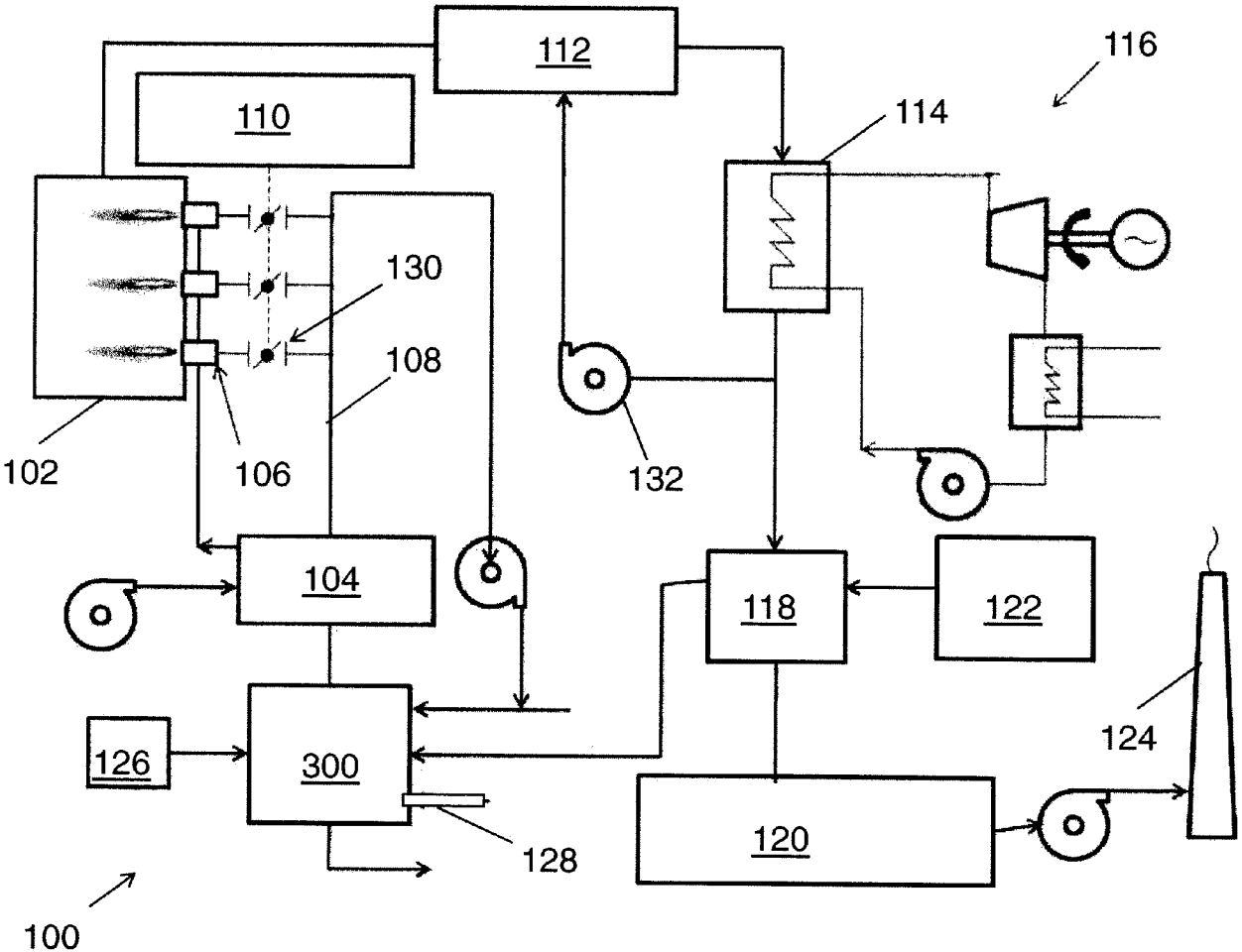
FIG. 1 shows a schematic view of a system including an exemplary cyclone gasifier according to an embodiment.
Figure 2:
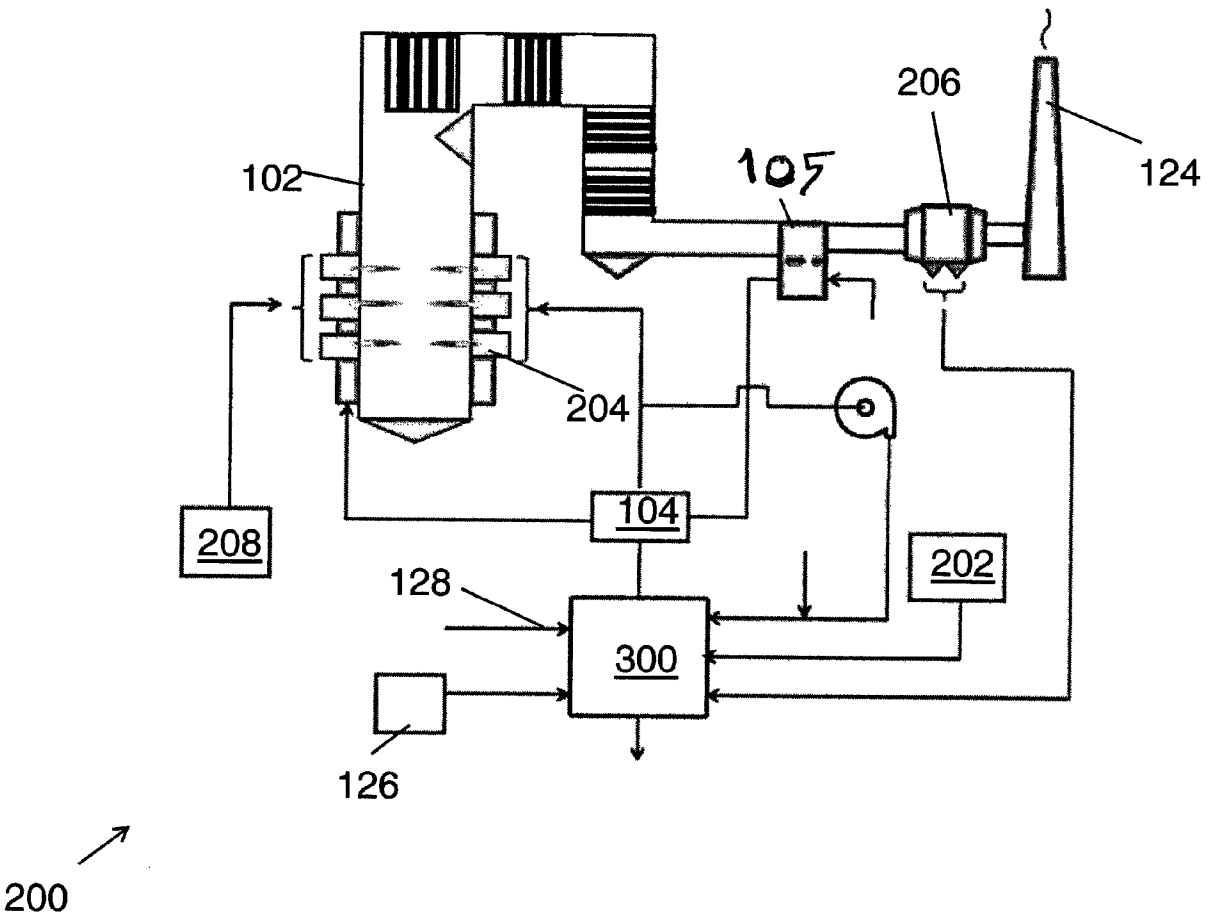
FIG. 2 shows a schematic view of a system including an exemplary cyclone gasifier according to an embodiment.
Figure 3:
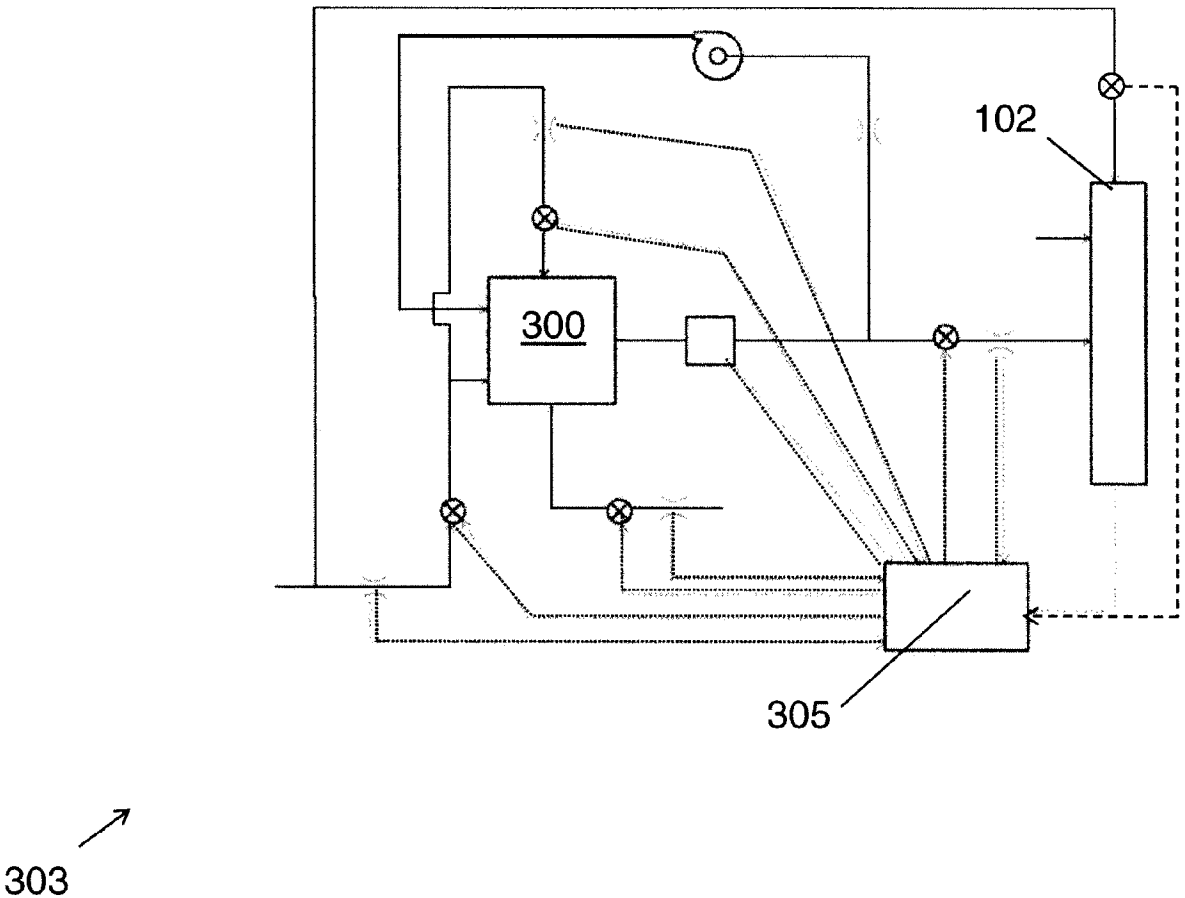
FIG. 3 shows a schematic view of a system including an exemplary cyclone gasifier according to an embodiment.

FIGS. 1, 2, and 3 show exemplary systems including an exemplary cyclone gasifier 300. FIGS. 4 through 13 show various views and/or embodiments of the gasifier 300. Suitable systems include, but are not limited to, energy-intensive systems (such as for pulp and paper, glass, steel, non-ferrous, utilities, biorefining) and systems retaining captive biomass feedstock or organic by-products (such as for forestry, pulp and paper, food processing—animal and vegetable, agriculture and biorefining), or other suitable systems seeking to displace fossil fuels with renewable fuels in heat and power production.

Referring to FIG. 1, the gasifier 300 may be included in a system 100, which may be suitable for combined heat and/or power applications. The system 100 supplies synthetic product gas to an industrial heating or melting furnace 102, such as a steel reheat furnace or a process boiler (which generally may be fired with natural gas). Synthetic product gas output from the gasifier 300 is delivered to a heat exchanger 104 (for example, a preheater for combustion air used in the industrial heating or melting furnace 102) prior to entering a fuel delivery header 108 and supplying burners 106 that provide heat to the furnace 102. Additional synthetic product gas pre-treatment may be included prior to injection in furnace 102, depending upon furnace requirements. The burners 106 may be low NOx burners (for example, burners that produce below 20 ppmv NOx emissions in an industrial furnace). Control of the burners 106 can be accomplished through actuated valves 130 that are linked with a control system 110 of the furnace 102. Adaptability of the system 100 to fluctuations in the furnace demand can be augmented by recycling a portion of the product gas for use as a secondary fuel in the gasifier 300. Temperature of the flue gas leaving the furnace 102 may vary, for example from 500° F. to 1500° F. (260° C. to 816° C.), depending on the specific industrial process. The flue gas is delivered to an attemperator 112, where temperature is lowered and stabilized, for example by recycling a portion of cool gas via recycle fan 132, then to an evaporator 114, where heat is exchanged with a working fluid such as water or an organic fluid such as butane or ammonia, and power is generated with a Rankine cycle generator 116. The choice of working fluid may be configured for the size of the system 100 and/or the temperature of flue gas exiting the furnace 102. Cooled gas from the evaporator 114 is either recycled to the attemperator 112, or delivered to a fuel drier 118, thus further increasing the efficiency of the system 100. System 100 may include any other suitable process elements. For example, system 100 may include a particulate/acid removal system 120, a biomass supplying system 122, a stack 124, an oxygen source 126, and/or an additive injector 128.

Referring to FIG. 2, the gasifier 300 may be included in a pulverized coal-fired power boiler system 200. The system 200 may produce synthetic gas from biomass or other renewable fuels and utilize the synthetic gas to partially or completely replace coal in the boiler. In one embodiment, the system 200 may be configured to pulverize coal and also to gasify biomass, where the biomass-derived synthetic gas supplies more than about 10% to 20% of the total energy to the boiler. High level bio-mass co-firing (for example, biomass co-firing to produce in excess of about 50% of the energy delivered to the boiler) may be achieved by gasifying the biomass in the gasifier 300, by using a single biomass feed 202, and/or by distributing and injecting the product gas into burners 204. In one embodiment, the system 200 may be substantially devoid of sulfur scrubbers or a selective catalytic reduction unit.

The gasifier 300 is configured to capture and remove solid particles from the synthetic product gas fuel stream, thereby reducing or eliminating a potential source of pollution and downstream fouling. Moreover, the gasifier 300 may convert inorganic material into slag that is an environmentally benign material. The gasifier 300 can be used to process fly ash from a particulate collection device 206, which may provide an environmentally preferable option to land-filling of fly ash, with potential for commercial sale of the slag (for example, as a blast or grit abrasive, roofing shingle granule, and/or aggregate in asphalt paving). Other suitable processing elements may be included in system 200. For example, system 200 may include a coal source 208 for providing coal to the furnace 102.

Portions of system 100 and/or system 200 may be used with other processes or systems. For example, a heat exchanger 105 may be used to heat a fluid not used in system 100 and/or system 200. Moreover, multiple suitable systems can be combined depending upon process heating and/or power requirements. Also, as will be appreciated, the gasifier 300 can be used in any suitable system having a suitable furnace. For example, the gasifier 300 can be used in the system 303 shown in FIG. 3 having a gasifier 300 and a furnace 102 controlled by a controller 305.

Figure 4:
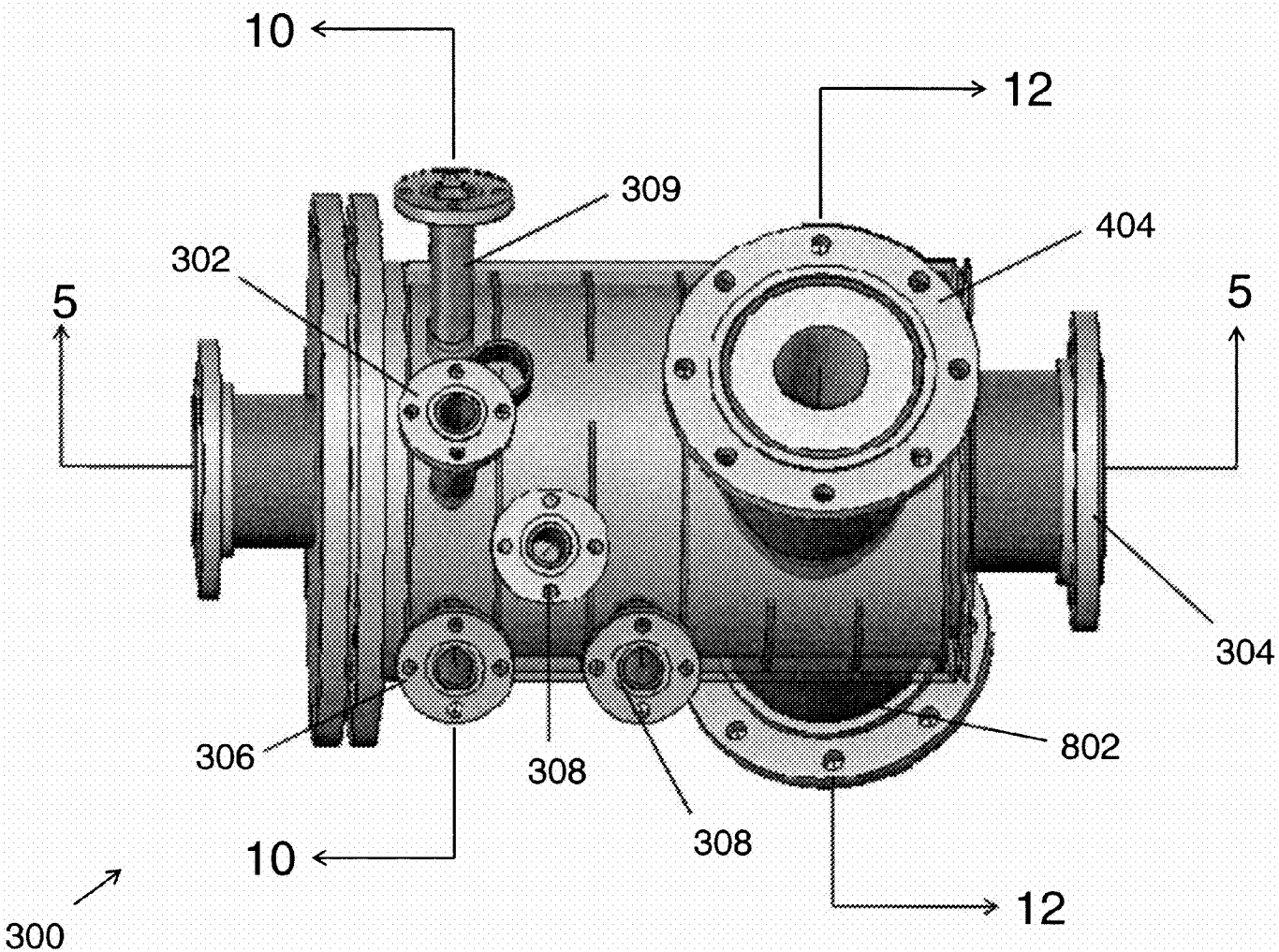
FIG. 4 shows an exemplary cyclone gasifier according to an embodiment.

Referring to FIG. 4, the gasifier 300 includes a first fuel injector 302 for introducing a first fuel (not shown), a second fuel injector 304 for introducing a second fuel (not shown), and an oxidant injector (for example, an accelerating oxidant injector 306) for accelerating the tangential velocity of the first fuel within the gasifier 300. In one embodiment, the fuel provided by the second fuel injector 304 to a secondary burner 414 (shown in FIG. 5) may be less than about 25% of the total energy input to the gasifier 300 (with the fuel provided by the first fuel injector 302 being greater than about 75% of the total energy input of the gasifier 300). In a further embodiment, the fuel provided by the second fuel injector 304 to the secondary burner 414 may be less than about 10% of the energy input to the gasifier 300 (with the fuel provided by the first fuel injector 302 being greater than about 90% of the total energy input of the gasifier 300). In an even further embodiment, the fuel provided by the second fuel injector 304 to the secondary burner 414 may be less than about 5% of the energy input to the gasifier 300 (with the fuel provided by the first fuel injector 302 being greater than about 95% of the total energy input of the gasifier 300).

The first fuel is introduced into a chamber 400 (described below with reference to FIG. 5) of the gasifier via the first fuel injector 302 at low velocity (for example, below about 60 ft/s), and swept into a tangential trajectory by a high velocity oxidant stream (for example, a stream having a velocity between about 200 ft/s and 400 ft/s). Centrifugal force acting upon particles of the first fuel accelerates the particles toward a wall 402 of the chamber 400, where the particles are substantially captured in a molten slag layer. The molten slag layer is formed by successive deposition and melting of solid fuel particles. The solid fuel particles captured and retained in a molten phase increase residence time within the gasifier 300. For example, the molten phase particles can have a residence time greater than about 1 minute in comparison to gas phase particles that can have a residence time of about 1 second. The extended residence time for the molten phase particles facilitates a high degree of gasification of solid carbon in the solid fuel (for example, a purely solid fuel, a slurry including solid fuel, or any other suitable fuel containing a solid fuel). Gas phase reaction is enhanced by turbulent mixing created by high gas velocity and radial pressure gradients created by tangential flows having a counter-flowing relation between the first fuel injector 302 and the second fuel injector 304 (as further described below) that induce secondary flows in three dimensions. Slag flows from a first end 408 (for example, an inlet end) to a second end 412 (for example, an outlet end) under the combined action of gravity and gas-driven shear. Slag exits through a slag discharge port 802 (for example, a slag tap) to a suitable collection device. Gas also flows generally from the first end 408 to the second end 412. A majority of solid residue/particulate is separated from the gas and the gas is discharged through an outlet 404 (for example, a gas exhaust port).

Figure 5:
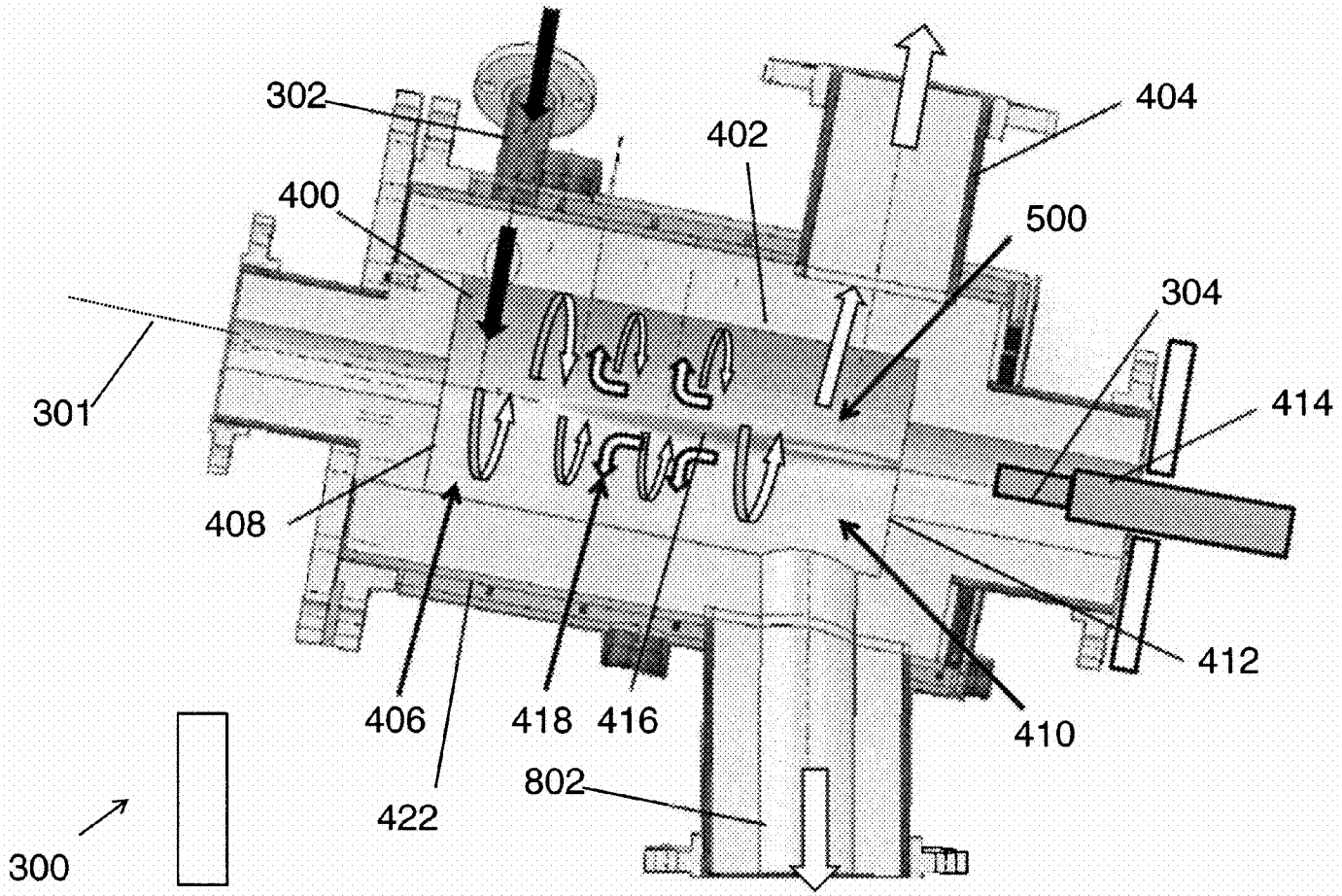
FIG. 5 shows a sectioned view of an exemplary cyclone gasifier along line 5-5 in FIG. 4 according to an embodiment.

In one embodiment, shown in FIG. 5, the secondary burner 414 is positioned in or in communication with the second portion 410 of the chamber 400 and is configured to direct secondary flame 416 toward the first portion 406. This configuration may be referred to as having a counter-current burner. The secondary flame 416 in the counter-current burner configuration forms a very high temperature flame (for example, above about 5000° F.) based upon the high concentration of oxygen in the oxidant. As used herein, except where specified otherwise, the term "oxygen" refers to an O2 content of at least about 30% by volume. Heat released from the secondary flame 416 maintains the temperature of the slag above a predetermined temperature that forms stable slag flow conditions for slag exiting the chamber 400 through the slag discharge port 802. The predetermined temperature can be T250, which is the temperature at which the viscosity is 250 poise.

The counter-current burner configuration permits the secondary flame 416 to entrain gas and particulate and to redirect the gas and particulate toward the first portion 406, thereby increasing residence time and improving gasifier 300 efficiency. The secondary flame 416 can act as an afterburner for synthetic product gas exiting the gasifier 300. As the synthetic product gas exits the gasifier 300, the synthetic product gas traverses a path 500 that maintains proximity to the secondary flame 416, raising the temperature of the synthetic product gas and intermixing the synthetic product gas with chemically active species. The increasing of the temperature and the intermixing improves gasification efficiency by gasifying fine particulate solid carbon in the synthetic product gas and molecularly reduces (or cracks) tars, if present, in the synthetic product gas. As used herein, the term "tars" refers to high molecular weight organic components formed during the early stage of a reaction, particularly in oxygen-deficient environments. Tars are prone to condense at high temperature, form a sticky substance, and are known to foul downstream process equipment such as valves and heat exchangers.

Figure 6:
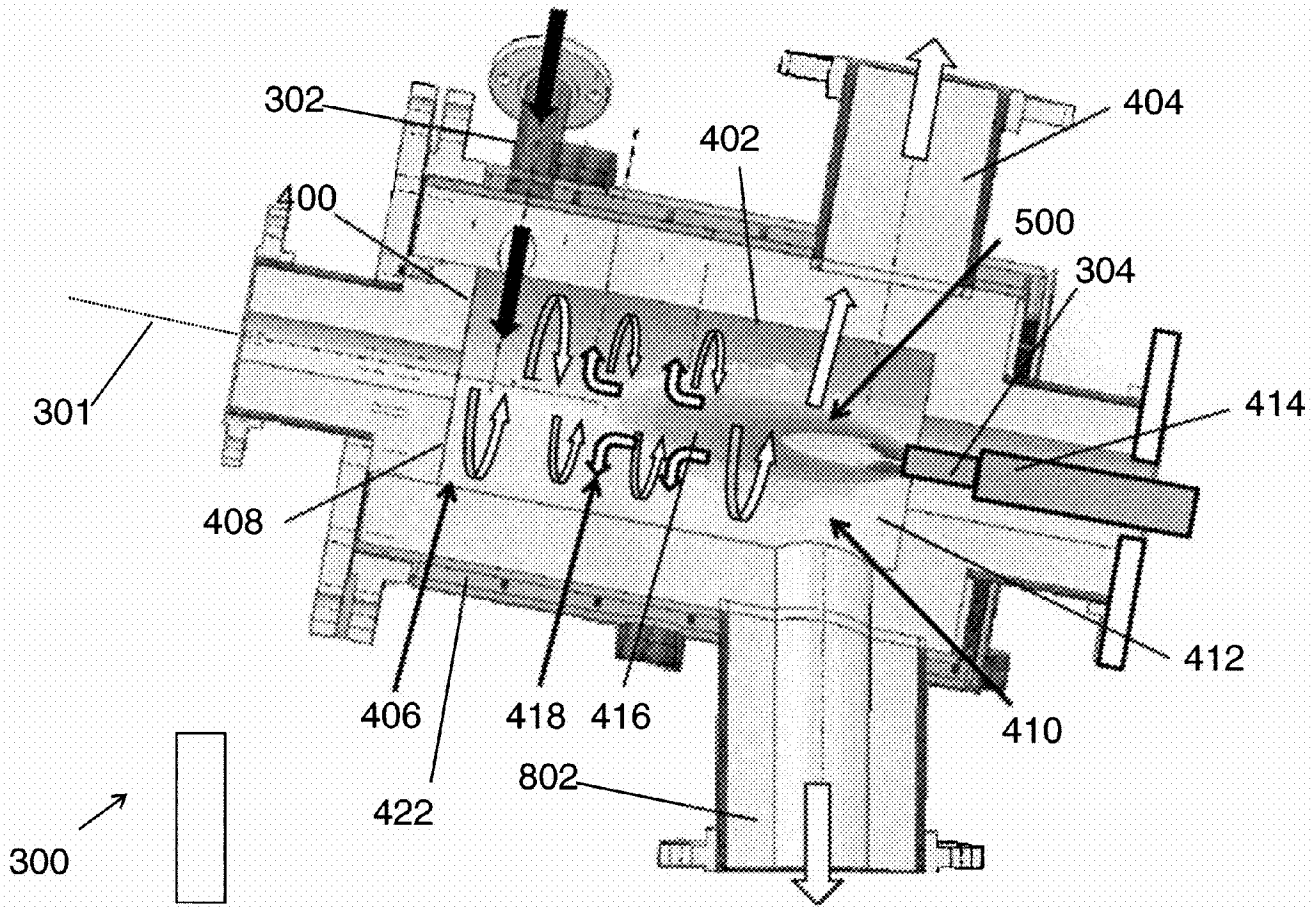
FIG. 6 shows a sectioned view of an exemplary cyclone gasifier according to an embodiment.

In one embodiment, the secondary fuel and oxidant are swirled with substantially the same orientation as the tangential flow within the chamber 400. The swirling can cause a radial expansion of the secondary flame 416, which in turn arrests forward momentum of the flame. The swirling can reduce or eliminate secondary flame impingement on the chamber 400 front wall 409. Secondary flame impingement can lead to failure of the wall 402. Broadening the flame can increase flame surface area. Increased flame surface area increases heating from the secondary flame 416 throughout the gasifier 300. In particular, heating of the first end 408 of the chamber 400 is improved with a swirled, counter-current secondary flame 416, by increasing the frontal area of the flame, thereby increasing the radiant view factor between the leading surface of the flame and the first end 408 of the chamber 400 (as shown in FIG. 6). The improved heating proximal to the first end 408 permits earlier heating of the solid fuel and the slag, increased reactor heat release, and increased slag flow stability. The swirled secondary flame 416 maintains the tangential flow field and more efficiently captures solid particles in the slag by forcing the solid particles toward the wall 402.

In one embodiment, the secondary burner 414 firing a secondary fuel with oxidant forms a secondary flame 416 that enters the chamber 400 from the second end 412 and is directed toward the first end 408. The secondary burner 414 provides a distributed supplementary heating source to accelerate gasification reactions, stabilize slag flow, reduce carry-over of particulate into the product stream, and enhance cyclonic action within the reactor. The secondary burner 414 facilitates at least partial oxidation of secondary fuel within the chamber 400. The secondary fuel may be solid, liquid, and/or gaseous. The at least partial oxidation of the secondary fuel forms a flame 416. The flame 416 is directed along the center axis 301 of the chamber 400. In one embodiment, the flame 416 extends over the length of the slag discharge port 802, providing thermal radiation that maintains the temperature in the second portion 410 above a predetermined temperature (for example, above the melting point of the slag). In one embodiment, the secondary burner 414 is operated with less than the stoichiometric amount of oxygen, to reduce or eliminate the oxidation of surrounding product gas. If the secondary fuel is gaseous, this sub-stoichiometric operation can increase secondary flame radiance, which can improve the efficiency of heating from the secondary flame 416 within the chamber 400.

The exterior of the gasifier 300 may include any suitable material. For example, the exterior may include steel, any other suitable material, or combinations thereof. The exterior of the gasifier 300 may be any suitable geometry for housing the chamber 400. The chamber 400 includes a first portion 406 proximal to the first end 408 and a second portion 410 proximal to the second end 412. All or a portion of the chamber 400 can include refractory material. The refractory material can include alloys of silica, alumina, iron, chromium, zirconium, and/or other high temperature materials. In one embodiment, the chamber 400 (or wall(s) 402 of the chamber 400) can include thermocouples for monitoring the temperature of the first portion 406, the second portion 410, and/or any other suitable portions of the chamber 400. Additionally or alternatively, all or a part of the chamber 400 can be water cooled by circulating water through a water jacket 422 (see FIG. 5).

In one embodiment, the chamber 400 is cylindrical in shape and may be referred to as a barrel. In the exemplary chamber 400, the chamber relies upon centrifugal forces and the "barrel" shape to separate product gas from slag. The fuel having an ash component can be introduced with a predetermined velocity. In one embodiment, the predetermined velocity is below about 60 ft/s. In another embodiment, the first fuel is introduced substantially devoid of a transport gas (non-pneumatically).

The low velocity first fuel is contacted by the high velocity oxidant prior to the first fuel contacting the wall 402 of the chamber 400. Contact between the first fuel and the oxidant prior to the first fuel making contact with the wall 402 prevents settling and/or piling of the particles within the reactor, and enables rapid entrainment of the fuel particles due to the much higher velocity of the first oxidant stream. The reduction or elimination of particle settling and/or particle piling permits more even depositing of fuel particles within the chamber 400. Generally, a velocity to pick up already deposited particles (a pickup velocity) is substantially higher than a velocity to retain particles in suspension (a saltation velocity). For example, the pickup velocity can be up to 2.5 times higher than the saltation velocity. Hence, by reducing or eliminating initial particle settling and/or particle piling, the fuel particles are more uniformly deposited within the chamber 400. This more uniform distribution can increase chemical reaction rates and/or enable higher heat release rates for a given volume of the chamber 400 by exposing more particulate surface area to high temperature and reactant gases. The velocity of the oxidant can be between about 200 ft/s and 400 ft/s. This range can (depending upon size and/or shape of the fuel particles) provide enough momentum to maintain the rapid particle entrainment and centrifugal action. In addition, this range can (depending upon size and/or shape of the fuel particles) avoid extremely high supply pressure and/or a tendency to solidify the slag layer by convective cooling.

Figure 8:
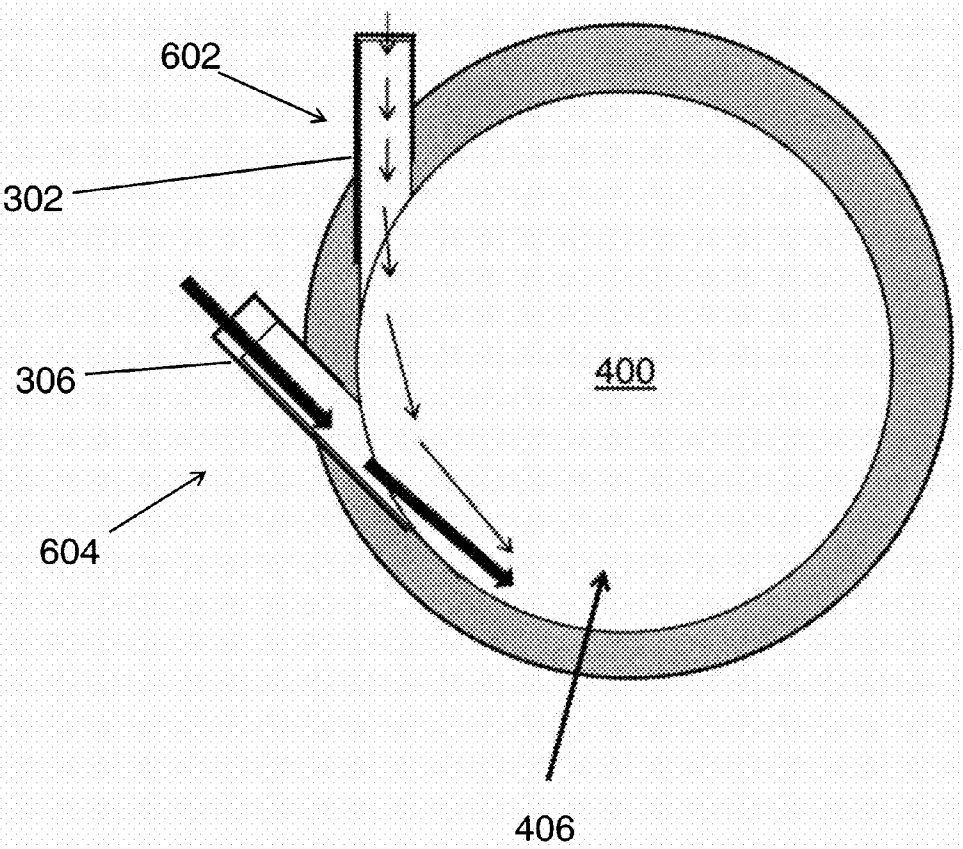
FIG. 8 shows a first portion of a chamber of an exemplary cyclone gasifier according to an embodiment.

The chamber 400 permits the gasifier 300 to gasify fuels (for example, solid fuels) with one or more oxidants (for example, oxygen containing gas). The chamber 400 is configured to receive fuel from first fuel injector 302 in the first portion 406 of the chamber 400 proximal to the first end 408 of the chamber 400. The velocity of the fuel introduced through the first fuel injector 302 is accelerated tangentially by the oxidant injected by the accelerating oxidant injector 306. FIG. 8 shows the initial path of the particles of the first fuel upon injection into the chamber 400. A first set of arrows 602 show the path of the particles of the first fuel. A second set of arrows 604 show the path of the oxidant. In each set of arrows 602, 604, a comparative velocity is shown by the length of the arrow. For example, a longer arrow represents a greater velocity for the particles/oxidant with the respective path. In each set of arrows 602, 604, a relative direction/trajectory of the particles is shown by the orientation of the arrow. For example, an arrow oriented vertically represents a downward direction/trajectory. In one embodiment, the oxidant can include an O2 concentration of greater than about 28% by volume. In another embodiment, the oxidant can include an O2 concentration of greater than about 50% by volume. In another embodiment, the oxidant can include an 02 concentration of greater than about 85% by volume.

Figure 9:
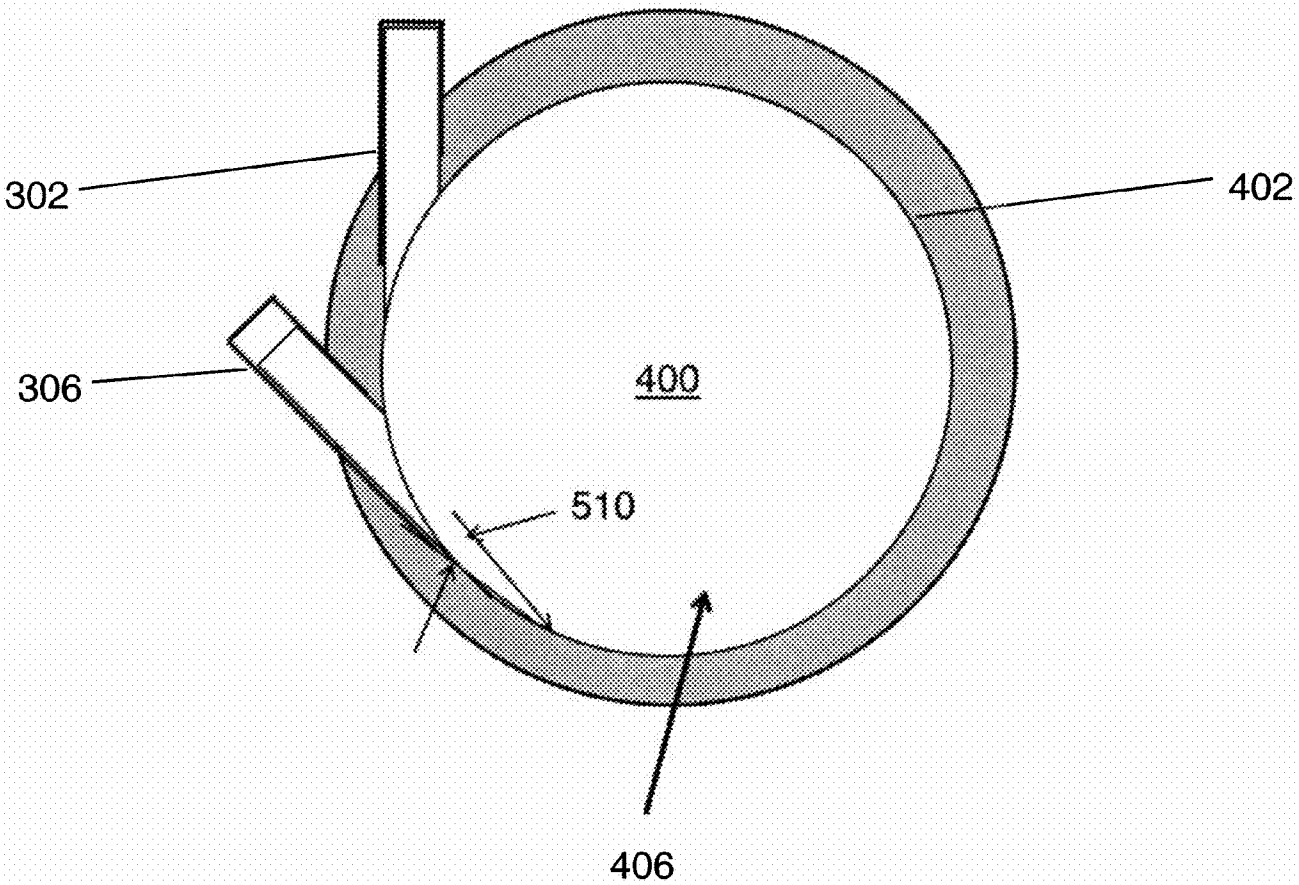
FIG. 9 shows a first portion of a chamber of an exemplary cyclone gasifier according to an embodiment.

The acceleration of the first fuel caused by interaction with the oxidant causes both centrifugal and linear shear forces to act on the fuel particles. The linear force maintains the particles in suspension by imparting a rapid increase in particle tangential velocity, thereby distributing the particles throughout the reactor volume, while the centrifugal force (caused by the tangential flow field) imparts radially outward movement of the particles, allowing them to deposit on the wall(s) 402 of the chamber 400. However, as shown in FIG. 9, due to the high oxidant velocity and the low fuel velocity, simultaneous entrainment of the fuel particles into the accelerating oxidant injector 306 maintains a contact angle 510 at initial fuel impact between the fuel particles and the wall 402 at a predetermined value, the predetermined value being low enough to reduce or eliminate erosion of the wall(s) 402. In one embodiment, the chamber 400 is angled from the first portion 406 to the second portion 410, thereby using gravitational forces to further facilitate the slag flow toward the slag discharge port 802. In a further embodiment, a center axis 301 (shown in FIGS. 5 and 7) of the chamber 400 is at an angle of about 10 degrees above the horizontal (for example, 10 degrees from being perpendicular to gravity).

Referring again to FIG. 4, a plurality of staged oxidant injectors 308 can be configured to facilitate staged oxidant injection. The staged oxidant injectors 308 tangentially introduce oxidant at predetermined positions along a flow path 418 (see FIG. 5) of gas within the chamber 400. The staged oxidant injection can create a velocity and temperature profile within the chamber 400. For example, viscous drag between a tangential flow field and the wall 402 lower the flow speed and gradually diminish the forces transporting the fuel particles and ash particles. In one embodiment, additional high velocity oxidant (for example, oxidant introduced at a velocity between about 200 ft/s and 400 ft/s) is staged into one or more of the staged oxidant injectors 308 to re-accelerate the tangential flow, thereby promoting continued transport of the solid particles. Simultaneously, the staged oxidant injectors 308 add additional oxidizer, releasing more chemical energy through fuel oxidation, which increases local temperatures. The increase of local temperatures increases reaction kinetics proximal to the first portion 406 of the chamber 400. In another embodiment, the velocity profile includes a low velocity of staged oxidant (for example, an oxidant introduced at less than about 200 ft/s) through staged oxidant injectors 308, which can add oxidizer without substantially accelerating the tangential flow field.

The desired combination of staged oxidant velocity and injection location can be determined by temperature measurement (for example, by monitoring the temperature within the chamber 400 via thermocouples embedded in the wall 402 or by monitoring exhaust gas temperature via thermocouples positioned in the exhaust gas stream). Additionally or alternatively, optimal reactor operating conditions can be determined by measurement of exhaust gas composition. For example, the composition can be determined by extractive sampling using a gas chromatograph, a mass spectrometer, a Raman spectrometer, or other suitable analytical or spectroscopic instrumentation. Additionally or alternatively, the gas composition can be measured in-situ using optical means such as a non-dispersive infrared analyzer. In one embodiment, the optimal reactor operating condition is determined by determining the consistency and carbon content of the slag. In this embodiment, the solid material exiting the slag discharge port 802 is analyzed. The monitoring of the conditions within the chamber 400 allows adjustments to be made to achieve desired results. The desired results can include substantial uniformity of temperature within the refractory (for example, temperature of the refractory being maintained within a range of about 50° C. or between about 1300° C. and about 1350° C.), achieving a predetermined exhaust gas temperature (for example, about 1400° C.), achieving a predetermined exhaust gas carbon monoxide concentration (for example, 50% by volume), achieving a predetermined exhaust gas particulate content (for example, less than about 10% of the total ash content of the first fuel), and/or achieving a predetermined carbon content in the slag (for example, less than about 10% by weight).

The staged oxidant injectors 308 are positioned at a predetermined distance from the outlet 404 (for example, at about ⅓ or about ⅔ the length of the gas flow path 418). The gas flow path 418 is the distance between the centerline of the first fuel injector 302 and the centerline of the gas outlet 404, as measured along the center axis 301 of the chamber 400.

Fuel injection by the first fuel injector 302 occurs at low velocity (for example, less than about 60 ft/s) and with little or no transport gas (for example, less than about 0.5 lb of transport gas per pound of solid fuel or no transport gas as in gravity feeding). Having little or no transport gas (such as conventional transport gases including air or nitrogen) can prevent the reactor temperature and synthetic gas heating value from being reduced by inert diluents.

Figures 10, 11:
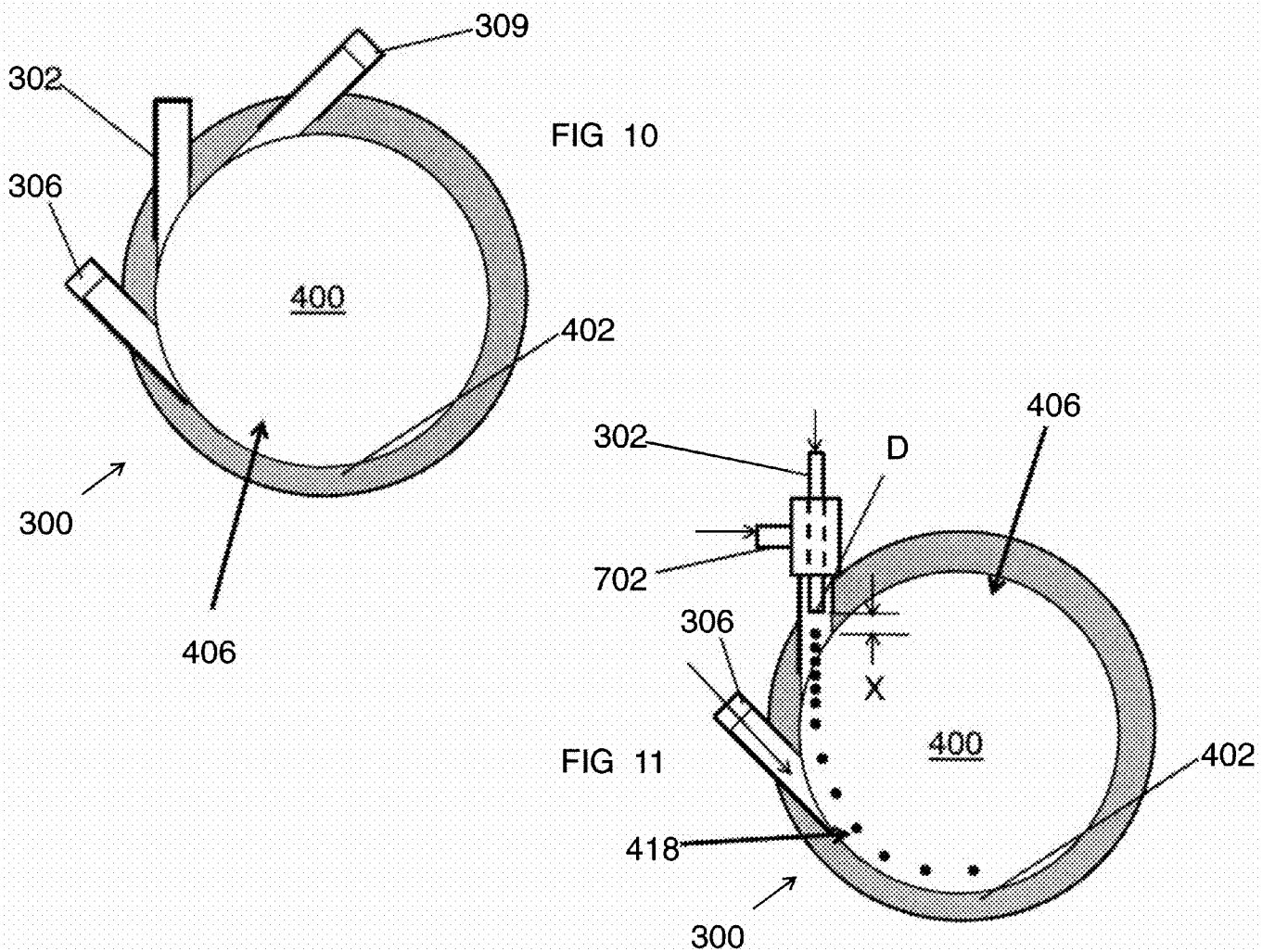
FIG. 10 shows a sectioned view of an exemplary cyclone gasifier along line 10-10 in FIG. 4 according to an embodiment.
FIG. 11 shows a first portion of a chamber of an exemplary cyclone gasifier according to an embodiment.

FIG. 10 shows a cross-section of an exemplary embodiment of the gasifier 300 shown in FIG. 4 along 10-10. FIG. 10 specifically shows the first portion 406 of chamber 400. As shown in FIG. 10, a preliminary oxidant injector 309 provides a preliminary oxidant stream to chamber 400. The preliminary oxidant injector 309 is positioned proximal to a fuel stream entering the chamber 400 from the first fuel injector 302. In one embodiment, the first fuel injector 302 may be positioned to provide a fuel stream between an oxidant stream provided by the accelerating oxidant injector 306 and a second oxidant stream provided by the preliminary oxidant injector 309. Introducing the fuel stream between the two oxidant streams may increase an oxidant-fuel interfacial area, improve ignition, accelerate fuel burning, and/or reduce/eliminate erosion of the wall(s) 402 of the chamber 400.

In one embodiment, a velocity of the oxidant stream provided by the preliminary oxidant injector 309 is preselected to be below a predetermined velocity that would increase the angle of contact 510 beyond a predetermined angle and undesirably erode the wall(s) 402 of the chamber 400. The velocity of this oxidant stream may also be above a predetermined velocity that would add viscous drag to the centrifugal motion and would retard the momentum of the fuel particles entrained by the first oxidant. In one embodiment, the velocity of this oxidant stream is between about 30 ft/s and about 60 ft/s.

Another embodiment includes the first fuel injector 302 providing fuel that is aspirated with oxidant through an annular oxidant injector 702. As used herein, the term "annular oxidant injector" and grammatical variations thereof refer to an oxidant injector configured to form a ring (either contiguous or non-contiguous) of oxidant. FIG. 11 shows a cross-section of this embodiment of the gasifier 300. FIG. 11 specifically shows an alternative embodiment of the first portion 406 of chamber 400. Annular oxidant injector 702 is positioned to introduce oxidant around (or substantially around), rather than only adjacent to the first fuel injector 302. Positioning the annular oxidant injector 702 around the first fuel injector 302 increases the fuel-oxidant interface and reduces or eliminates dilution of fuel-oxidant reactions caused by surrounding gases.

In one embodiment, the annular oxidant injector 702 is positioned to mix oxidant and fuel prior to these streams contacting the wall(s) 402 of the chamber 400. For example, the fuel nozzle of the annular oxidant injector 702 can be retracted from the wall(s) 402 of the chamber 400 by a predetermined distance X. The predetermined distance X can be selected to be above a distance to initiate ignition at a preselected duration and/or can be selected to form a fuel reaction above a preselected degree. Increasing the predetermined distance X increases the degree of mixing of the fuel and oxidant prior to entering the gasifier 300 and provides earlier initiation of fuel ignition and a greater degree of fuel reaction prior to entering the gasifier 300. Additionally or alternatively, the predetermined distance X can be selected to be below a distance corresponding to an amount of damage caused to the annular oxidant injector 702 and/or the wall(s) 402. Decreasing the predetermined distance X reduces or eliminates damage to the annular oxidant injector 702 and wall(s) 402 of the chamber 400. In one embodiment, the predetermined distance X is less than about twice the hydraulic diameter of the fuel nozzle (the hydraulic diameter being equal to 4 times the cross-sectional area divided by the perimeter). In one embodiment, the predetermined distance X is less than about five times the hydraulic diameter of the fuel nozzle.

Figure 12:
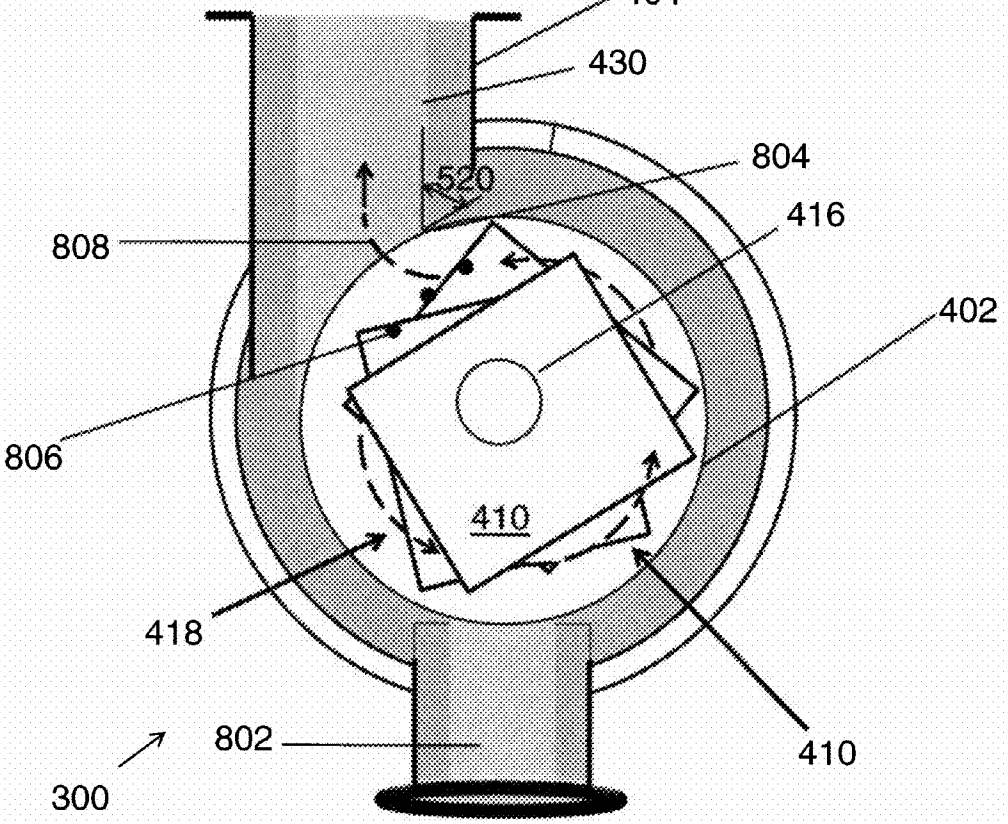
FIG. 12 shows a sectioned view of an exemplary cyclone gasifier along line 12-12 in FIG. 4 according to an embodiment.
Figure 13:
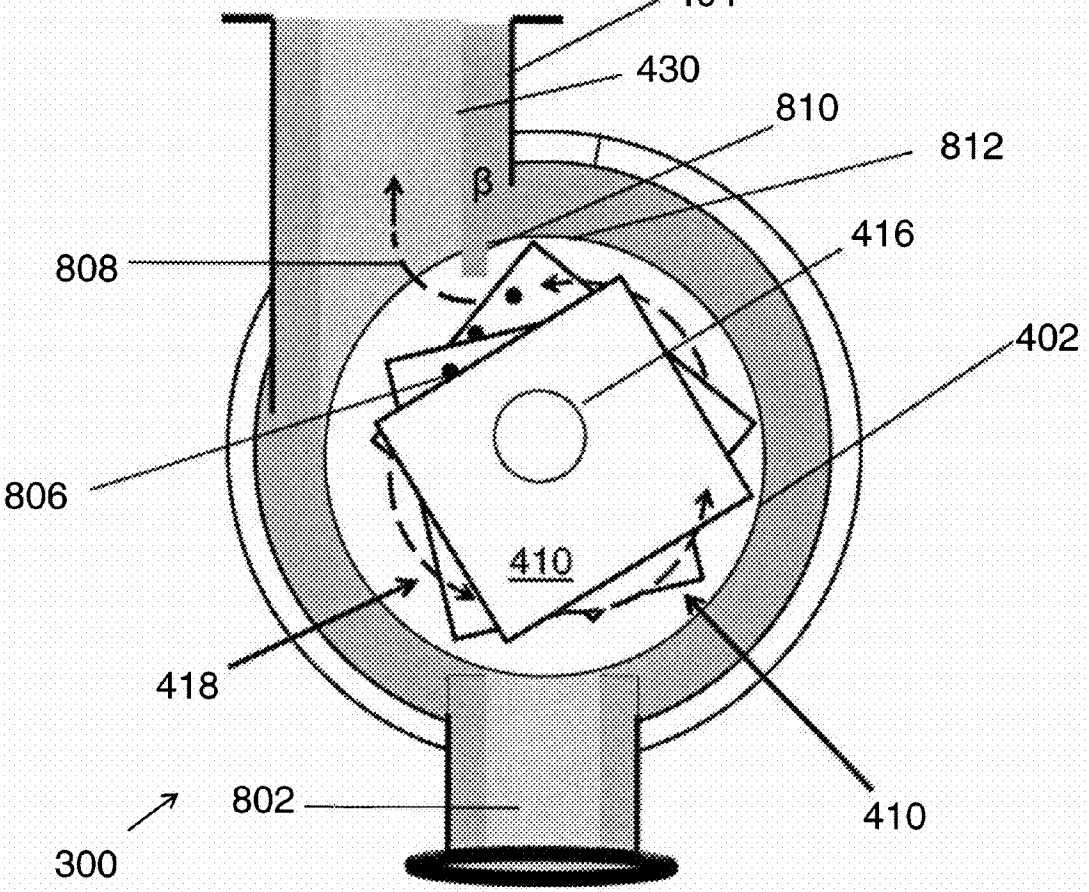
FIG. 13 shows a second portion of a chamber of an exemplary cyclone gasifier according to an embodiment.

FIG. 12 shows a cross-section of the exemplary gasifier 300 shown in FIG. 4 along 12-12. FIG. 12 specifically shows second portion 410 of chamber 400. In this embodiment, further separation of product gas and solid particulate is achieved by forming an acute angle 520 between an upper region 804 of the wall 402 and the gas outlet 404. The acute angle 520 causes a sharp curvature of the exit gas flow. The solid particles/particulate are substantially prevented from entering the gas outlet 404 by the sharp curvature and follow a solid particle path 806. Specifically, the inertia of the solid particles upstream of the acute angle 520 forces the solid particles beyond the outlet 404 (in contrast to the product gas path 808) and subjects the solid particles to entrainment within the centrifugal field of the chamber 400. In another embodiment, similar effects are produced by positioning a protruding member 810 between the upper region 804 of the wall 402 and the gas outlet 404 (see FIG. 13). The acute angle 520, the protruding member 810, and/or other suitable features can form a tortuous path for the product gas formed by gasification. The tortuous path can separate particulate from the product gas.

Figure 7:
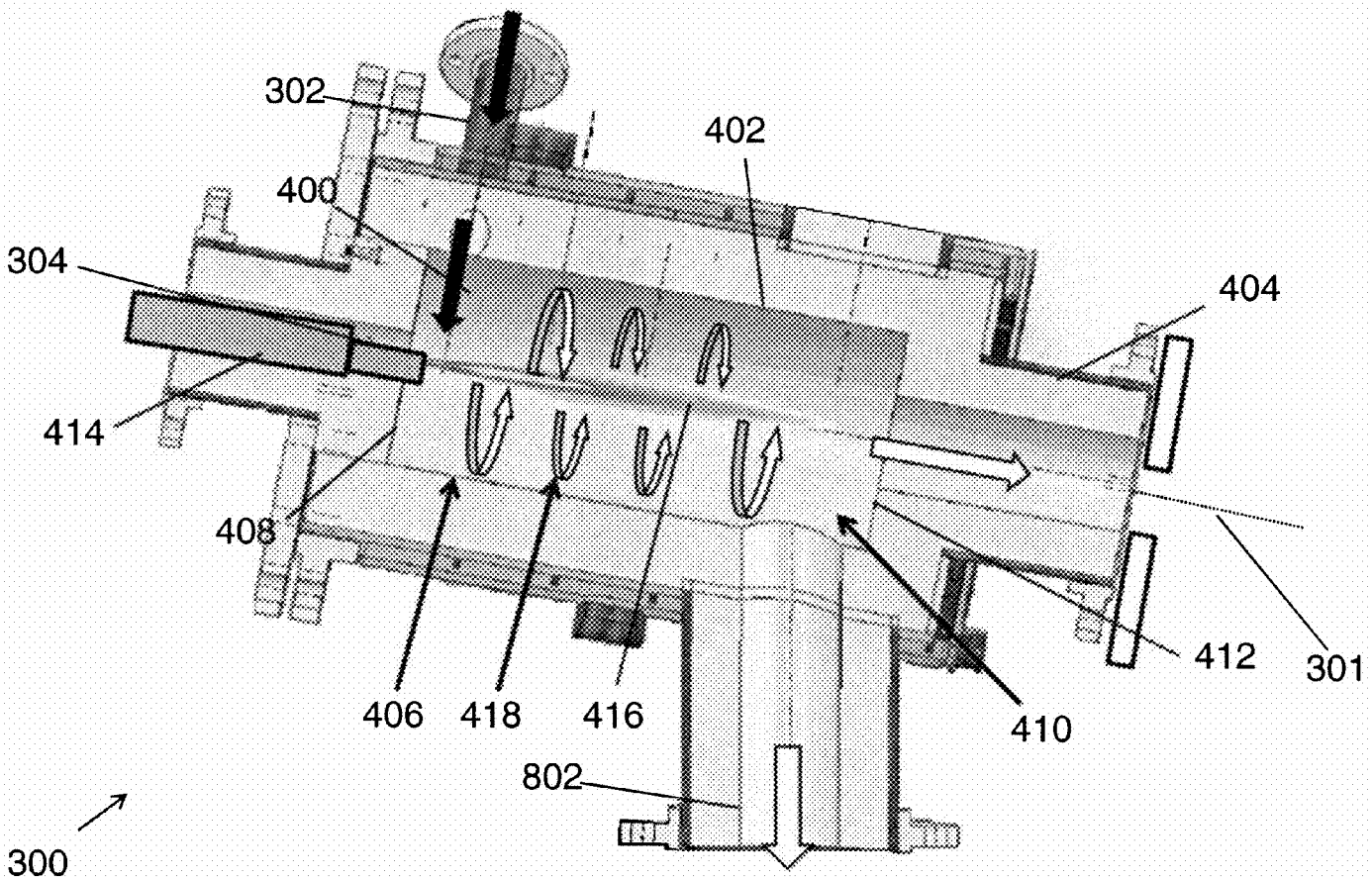
FIG. 7 shows a sectioned view of an exemplary cyclone gasifier according to an embodiment.

In an alternate embodiment, shown in FIG. 7, the secondary burner 414 is positioned in the first portion 406 of the chamber 400 and is configured to direct secondary flame 416 toward the second portion 410. This configuration may be referred to as having a co-current burner. The secondary flame 416 in the co-current burner configuration forms a temperature distribution with highest temperatures being in the first portion 406 of the chamber and, as such, forms a slag viscosity distribution with the slag having a lower viscosity in the first portion 406 and a higher viscosity in the second portion 410.

In one embodiment, a predetermined value of the angle of contact 510 is selected to reduce erosion of material in the wall(s) 402 of the chamber 400. Erosion of the wall(s) 402 is dependent upon the velocity and trajectory of the fuel particles, the size of the fuel particles, the shape of the fuel particles, the hardness of the fuel particles, and/or the relative ductility of the material forming the wall(s) 402. In one embodiment, the velocity and trajectory of the fuel particles are controlled in response to the size of the fuel particles, the shape of the fuel particles, the hardness of the fuel particles, and/or the relative ductility of the material forming the wall(s) 402.

Figure 14:
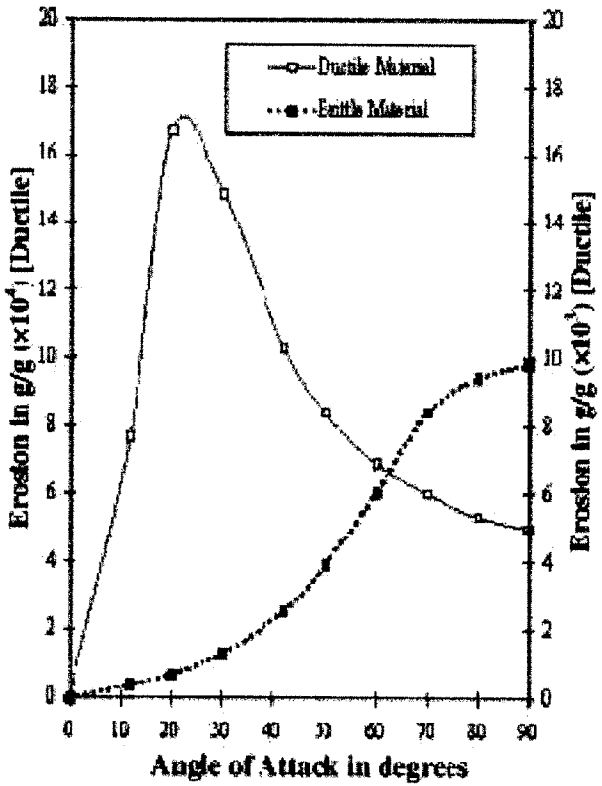
FIG. 14 shows an exemplary plot of erosion rate data versus angle of contact for a brittle material and a ductile material.

FIG. 14 shows an exemplary plot of erosion rate data versus angle of contact for a brittle material and a ductile material. Brittle materials include ceramics. Ductile materials include annealed steel. The relative ductility of refractory can vary based upon the temperature of the refractory. In general, ductility increases with an increase in temperature. In the chamber 400, the temperature of the wall 402 in the first portion 406 is cooler than the other portions of the chamber 400. The cooler temperature of the first portion 406 results in the material of the wall 402 in the first portion 406 being more brittle than the other portions of the chamber 400. The erosion rates for the brittle material continuously increase as the angle of attack increases to 90 degrees. The erosion rates for the ductile material peak at an angle of contact of about 20 to about 30 degrees. In one embodiment, the erosion rates are reduced by maintaining the angle of contact below about 20 degrees. In one embodiment, maintaining the angle of attack below about 20 degrees is achieved by maintaining a fuel injection velocity below about 60 ft/s and a first oxidant velocity between about 200 ft/s and 400 ft/s. In a further embodiment, the angle of contact is maintained below about 10 degrees and the fuel injection velocity is maintained below about 30 ft/s.

In one embodiment, the preliminary oxidant injector 309 and/or the staged oxidant injector(s) 308 adjust the flame characteristics by adjusting aerodynamics (for example, velocity and trajectory of reactants) of the secondary burner 414. For example, temperature within the chamber 400, chemical kinetics within the chamber 400, and slag flow within the chamber 400 may be adjusted by swirling of fuel from the secondary burner 414 (which may or may not correspond in direction with the swirl of the fuel), swirling of oxidant from the preliminary oxidant injector 309, and/or swirling of oxidant from the staged oxidant injector(s) 308. Such adjustments may widen and/or shorten the secondary flame 416. This may increase the area of the secondary flame 416 resulting in increased projection of radiation from the secondary flame 416 throughout the chamber 400.

The chamber 400 may be configured to promoting a vortex to support the centrifugal forces forcing the gas flow path 418 to swirl along the wall 402 of the chamber 400. The promotion of the vortex may be achieved (in whole or in part) by the geometry of the chamber 400 (for example, being cylindrical), the positioning of the accelerating oxidant injector 306, the positioning of the preliminary oxidant injector 309, the staged oxidant injector(s) 308, the location, design, and operating conditions of the secondary burner 414, and the velocity of the fuel and first oxidant.

Embodiments of the present disclosure can gasify solid fuels to produce a synthetic gas with little or no inert component. For example, one or more of the oxidants in the reactor can be enriched in oxygen concentration relative to air. This can permit the volume of the inert gas (for example, nitrogen) to be reduced or eliminated. However, reducing the volume of the inert gas can reduce gas momentum that drives the cyclonic action. The size of the reactor may be compact enough to permit the reactor to operate with a high heat release (Q) to volume (V) ratio (for example, a ON of greater than or equal to about 10 MW/m3), with the heat release (Q) being a higher heating value of the first fuel and the second fuel and volume (V) being the total reactor volume. Thus, the reactor may be configured for increased utilization of the reactor volume by increased surface area, increased heating and/or ignition of solid fuel particles, increased residence time, and/or increased uniformity of temperature distribution.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A cyclone gasifier, comprising:

a chamber having a first portion proximal to a first end and a second portion proximal to a second end;

a first fuel injector positioned for introducing a first fuel tangentially into the first portion of the chamber with a tangential velocity;

a burner positioned for introducing a second fuel to the second portion of the chamber; and an oxidant injector positioned for introducing oxidant tangentially into the first portion of the chamber to accelerate the tangential velocity of the first fuel and swirl the first fuel from the first portion toward the second portion;

wherein the burner is configured to direct a flame toward the first portion from the second portion;

wherein the second portion includes a flow path for a product gas formed by gasification of at least the first fuel to exit the furnace; and wherein the first fuel includes a solid fuel.

2. The gasifier of claim 1, wherein the first fuel injector is a non-pneumatic fuel injector.

3. The gasifier of claim 2, wherein the first fuel injector is a low velocity fuel injector configured for injecting the first fuel at less than about 60 ft/s.

4. The gasifier of claim 1, further comprising one or more staged oxidant injectors configured to maintain the swirl of the first fuel from the first portion toward the second portion.

5. The gasifier of claim 1, wherein the burner is configured to swirl the flame, the swirl of the flame corresponding to the swirl of the first fuel.

6. The gasifier of claim 1, wherein the burner includes a second fuel injector and an oxygen injector.

7. The gasifier of claim 1, wherein the first fuel and the second fuel differ in composition.

8. The gasifier of claim 1, wherein the flow path includes a sharp curvature such that the inertia of solid particles contained in the product as renders the solid particles unable to exit the furnace with the product gas.

9. The gasifier of claim 1, further comprising an annular oxidant injector arranged around the first fuel injector for introducing oxidant tangentially in an annulus at least partially surrounding the first fuel injector to promote the gasification of at least the first fuel.

10. A cyclone gasifier, comprising:

a chamber having a first portion proximal to a first end and a second portion proximal to a second end;

a first fuel injector positioned for introducing a first fuel tangentially into the first portion of the chamber with a tangential velocity;

a burner including a second fuel injector positioned for introducing a second fuel to the chamber; and an oxidant injector positioned for introducing oxidant tangentially into the first portion of the chamber and configured to accelerate the tangential velocity of the first fuel and swirl the first fuel from the first portion toward the second portion;

an annular oxidant injector positioned for introducing oxidant tangentially in an annulus at least partially surrounding the first fuel injector;

a gas discharge outlet on the second portion; and a slag discharge port on the second portion; and wherein the second portion includes a flow path for a product gas formed by gasification of the first fuel, the second fuel, or a combination thereof;

wherein the first fuel includes a solid fuel.

11. The gasifier of claim 1, wherein the first fuel injector is configured such that the first fuel is introduced at a velocity of less than about 60 ft/s.

12. The gasifier of claim 1, wherein the oxidant injector is configured such that the accelerating oxidant is introduced at a velocity of about 200 ft/s to about 400 ft/s.

13. The gasifier of claim 1, wherein the oxidant injector is positioned to cause the oxidant to contact the first fuel prior to the first fuel contacting the wall of the chamber.

* * * * *